US009873097B1

(12) United States Patent
Dushine et al.

(10) Patent No.: US 9,873,097 B1
(45) Date of Patent: Jan. 23, 2018

(54) MAGNETIC STIRRING SYSTEM FOR WINE AERATION AND METHOD OF USING SAME

(71) Applicants: Boris Dushine, Highland Beach, FL (US); Annya Dushine, Boca Raton, FL (US)

(72) Inventors: Boris Dushine, Highland Beach, FL (US); Annya Dushine, Boca Raton, FL (US)

( * ) Notice: Subject to any disclaimer, the term of this patent is extended or adjusted under 35 U.S.C. 154(b) by 0 days.

(21) Appl. No.: 15/648,429

(22) Filed: Jul. 12, 2017

(51) Int. Cl.

| | |
|---|---|
| ***B01F 13/00*** | (2006.01) |
| ***B01F 7/00*** | (2006.01) |
| ***B01F 13/08*** | (2006.01) |
| ***B01F 7/16*** | (2006.01) |
| ***B01F 15/00*** | (2006.01) |
| ***B01F 3/04*** | (2006.01) |

(52) U.S. Cl.
CPC ..... *B01F 13/0845* (2013.01); *B01F 3/04595* (2013.01); *B01F 3/04794* (2013.01); *B01F 7/00291* (2013.01); *B01F 7/162* (2013.01); *B01F 15/00538* (2013.01); *B01F 2015/00597* (2013.01)

(58) Field of Classification Search
CPC .. B01F 13/0845; B01F 7/162; B01F 7/00291; B01F 15/00538; B01F 2015/00597
USPC ..... 366/273, 274
See application file for complete search history.

(56) References Cited

U.S. PATENT DOCUMENTS

| | | | | |
|---|---|---|---|---|
| 4,498,785 | A | 2/1985 | De Bruyne | |
| 5,797,313 | A | 8/1998 | Rothley | |
| 6,332,706 | B1 * | 12/2001 | Hall | B01F 3/04794 261/83 |
| 8,480,292 | B2 | 7/2013 | Dushine et al. | |
| 2006/0172041 | A1 | 8/2006 | Farrell | |
| 2010/0020634 | A1 | 1/2010 | Kosmoski et al. | |
| 2011/0293807 | A1 | 12/2011 | Dushine et al. | |
| 2014/0263461 | A1 | 9/2014 | Prokop | |
| 2014/0308416 | A1 | 10/2014 | Cheng | |
| 2015/0314253 | A1 | 11/2015 | Cysewski et al. | |
| 2015/0329809 | A1 | 11/2015 | Cifaldi | |
| 2016/0339398 | A1 | 11/2016 | Stevenson et al. | |

* cited by examiner

*Primary Examiner* — Tony G Soohoo
*Assistant Examiner* — Anshu Bhatia
(74) *Attorney, Agent, or Firm* — Chalin A. Smith; Smith Patent, LLC

(57) ABSTRACT

A system and method for automatically aerating drinking products, particularly wine, suitable home, business and/or industrial use is described herein. The system of the present invention is specifically designed for aerating wine for human consumption and includes a multipurpose stirring, storing and serving vessel having a captive magnetic stirring impeller coupled thereto and a programmable magnetic stir plate adapted for use therewith.

29 Claims, 14 Drawing Sheets

MAGNETIC STIRRING SYSTEM FOR WINE AERATION AND METHOD OF USING SAME

FIELD OF THE INVENTION

The present invention relates broadly and generally to the field of magnetic stirrers or mixers suitable for industrial, business and home consumer use, as exemplified by U.S. Pat. No. 8,480,292 (Dushine et al.), the contents of which are incorporated by reference in their entirety. More particularly, the present invention relates an automated wine aeration system in which a magnetically induced vortex is used to expose wine to air as well as methods using same.

BACKGROUND

Wine lovers have known for centuries that decanting wine before serving it often improves its flavor. Exposing wine to air—a process referred to as letting the wine "breathe"—does triggers two critical processes, namely oxidation and evaporation. Wine is made up hundreds of organic compounds and, in general, the volatile ones constitute the less desirable notes. Exposure to air allows these undesirable compounds to evaporate faster than the desirable, aromatic and flavorful ones, leaving behind a wine that is smoother and more appealing. Two particular categories of compounds that tend to reduced with aeration, include sulfites, which are generally added to wine to prevent oxidation and microbial activity, and sulfides, which are naturally occurring. Both can negatively impact the smell (or "bouquet") as well as flavor of the wine. Likewise, excess ethanol notes can be reduced with aeration.

As the wine "breathes", it will also begin to oxidize and the flavors and aromas will flatten out. The more dense and concentrated a wine is, the more it will benefit from aeration and the longer it can go before beginning to fade. A decanter has been traditionally used to accomplish aeration but can be time consuming: while older, more full-bodied red wines, and even some white wines, are improved after 25 to 30 minutes, intensely tannic or younger red wines may need 1-3 hours to achieve optimal results. Accordingly, there are many aerating devices and methods available in the marketplace offering means to accelerate the process.

Of the currently available methods, some involve actively introducing air into the wine bottle, for example with a aeration element or "bubble" such as described in U.S. Pat. No. 5,595,104 (Delaplaine). Others devices attempt to provide a greater exposure to surrounding air while the wine is being poured; see, for example, the Venturi apparatus described in U.S. Pat. No. 7,841,584 (Sabadicci et al.). Still others attempt to agitate the wine, for example by means of a stirring mechanism that is either inserted into the original bottle or a separate decanter. For example, wine stirrers that use a small rotating magnetic stir bar to "swirl" and aerate are known in the art, as exemplified by U.S. Pat. No. 6,332,706 (Hall) and U.S. Patent Publication Nos. 2015/0314253 (Cysewski et al.) and 2015/0329809 (Cifaldi). However, these "magnetic stirrers" have a number of drawbacks.

To prepare solutions, magnetic mixers and stirrers have been used by the scientific community in chemistry and biology and in academic and industrial laboratories for decades. The first U.S. Patent titled "Magnetic Stirrer", U.S. Pat. No. 2,350,534, was issued in 1944 and included a coated stir bar. In terms of the critical components, little has changed since then. Namely, an industrial or laboratory grade magnetic stirrer includes three primary elements: a flat-topped housing (referred to in the art as the "stir plate") that includes internal rotating drive magnet(s), a coordinating flat-bottomed vessel (such as a flask or beaker), and a small magnetic stir bar. In use, the magnetic stir bar is placed in the vessel containing the liquid or solution of interest. Then, the two are placed on the stir plate. Activation of the drive magnet(s) in the stir plate causes the corresponding magnetic stir bar to rotate and thereby generate a mass of whirling, swirling fluid referred to in the art as a "vortex", which, in turn, causes the fluid to be mixed or stirred.

In the context of magnetic stirring systems, the magnetic stir bar must properly "coupled" with the corresponding drive magnet. However, calculating the attractive force between two magnets is, in the general case, an extremely complex operation, as it depends on the shape, magnetization, orientation and separation of the magnets. Furthermore, the coupling or magnetic attraction of the stir bar to the drive magnet is very fragile and depends on a few variable parameters like positioning center of the magnetic schematic, RPM of the motor, viscosity of the fluid, and length of the stir bar, etc. Accordingly, centering the vessel, and more particularly the magnetic stir bar freely moving in the fluid contained therein, on the stir plate is critical to functionality. However, even when the plate has a printed target directly over the center to help find it, this is not an easy task. Moreover, as magnetic attraction force is very sensitive to the distance or separation between two magnets and exponentially reduces with distance, even small errors in alignment can result in the stir bar being decoupled, or "spun out". Thus, conventional systems recommend that the stirring speed be incrementally increased, very slowly, until the desired vortex pattern is achieved.

In the magnetic wine aerators of the prior art such as exemplified by Hall, Cysewski, and Cifaldi referenced above, the stir bar is unattached and thus allowed to move freely around the bottom of the vessel in a potentially distracting manner. However, other disadvantages also arise. For example, as wine is poured out of the container, the unsecured stir bar has a high likelihood of falling out of the vessel where, at best, it may be lost (thereby rendering useless the entire system) and, in a worse case, constitute a significant choking hazard. More critically, such systems tend to be plagued by the problem of "spin out" discussed above. In particular, the horizontal orientation of magnetization along the length of the stir bar, along with its relatively small size and the relatively low magnetic energy of its constituting material, contribute to a weak magnetic coupling force which, in turn, makes decoupling much more probable and problematic. While low speeds tend to reduce decoupling, they are incapable of generating a vortex of sufficient surface area in a large volume vessel, especially when using small stir bars such as described in the prior art. Furthermore, due to the size, shape and Teflon-coated AlNiCo construction, conventional stir bars tend to readily demagnetize, particularly when separated from the magnet assembly of the stir plate for any length of time.

Accordingly, there is a need in the art for an improved magnetically-driven wine aerating system that solves these and other problems of the prior art.

SUMMARY OF THE INVENTION

Further to the above-noted need in the art, it is accordingly an objective of the present invention to provide a magnetic stirring system, more specifically, a system comprised of a decanter-like vessel having a captive magnetic stirring impeller retained therein coupled to a magnetic stir plate afforded with positioning elements as well as control and actuating elements. The present invention overcomes the drawbacks of the prior art by providing a captive magnetic stirring impeller, more specifically, an impeller that may be coordinated to the base of the vessel by snapping into a pre-fabricated peripheral rib disposed at the base of the vessel and then rotated by means of a magnetic field to create a vortex within the wine, thus increasing the surface area of the wine in contact with air. Scientists and wine enthusiasts alike have long known that the swirling motion that mixes oxygen into a wine enhances its flavor. The shape, depth and speed of the vortex can greatly contribute to the process of aeration. The forces created inside of the vortex affecting the wine is the centrifugal force pushing the liquid to the outside of the glass and the gravitational force shoving the liquid back down.

A further object of the present invention is to provide a multipurpose decanter vessel adapted to function as a stirring vessel, serving vessel and storage vessel. The captive magnetic stirring impeller is retained within the vessel, thereby creating an integrated magnetic stirring vessel. The magnetic stirring vessel represents an apparatus that can function with existing industrial magnetic stirrers or as a component of an integrated stirring system. Through empirical testing, specifications have been optimized for the size and shape of the vessel. As discovered herein, fluid dynamics demonstrate that as the wave propagates along the glass wall, the liquid is displaced back and forth from bottom to top and from the center to the periphery. In addition, for a given glass shape, the mixing and oxygenation may be optimized with an appropriate choice of vessel diameter and rotation speed.

It is a further object of the present invention to provide a method for a acceleration and deceleration control system wherein a DC motor drives the integrated stirring system. This automated control system offers better stirring and oxygenation over a manual speed adjustment control, provided that operating parameters are carefully optimized. One simple and easy way to control the speed of a motor is to regulate the amount of voltage across its terminals and this can be achieved using "Pulse Width Modulation" or PWM. This PWM signal is generated by the microcontroller and in charge of the acceleration and deceleration profiles computation. The algorithm of this nature presented in this invention determines the acceleration/deceleration profile. The rate profile employed may be symmetric, such as represented by FIG. 5B, or asymmetric, as shown in FIG. 5A. In the context of the present invention, asymmetric rates are particularly preferred. The linear acceleration ramp or wind-up motor speed rate built into the controller dramatically reduces decoupling of the impeller when compared to a traditional manual rotational knob control. There is also the deceleration ramp. Fluid dynamists have long observed that orbital stirring generates a wave that propagates around the inner edge of the glass, churning the liquid as it travels. The formation of wine waves begins to break, turning frothy, if the waves are moving too quickly and abruptly stop. The third deceleration ramp is introduced in the control program of the present invention, which allows the froth to subside before serving.

The objectives, aspects and features of the invention discussed herein above will become more fully apparent when the following detailed description is read in conjunction with the accompanying figures and/or examples. However, it is to be understood that both the foregoing summary of the invention and the following detailed description are of preferred embodiments and not restrictive of the invention or other alternate embodiments of the invention. Various modifications and applications may occur to those who are skilled in the art, without departing from the spirit and the scope of the invention, as described by the appended claims. Likewise, other objectives, features, benefits and advantages of the present invention will be apparent from this summary and certain embodiments described below, and will be readily apparent to those skilled in the art having knowledge in the magnetic mixing arts. Such objectives, features, benefits and advantages apparent from the above in conjunction with the accompanying examples, data, figures and all reasonable inferences to be drawn there-from are specifically incorporated herein.

BRIEF DESCRIPTION OF THE FIGURES

The above-mentioned features and objects, as well as various additional aspects and applications of the present invention, will become apparent to the skilled artisan upon consideration of the detailed description of the present invention and its preferred embodiments that follows, as well as the illustrative figures that accompany this application, wherein like reference numerals denote like elements.

DETAILED DESCRIPTION OF THE PREFERRED EMBODIMENTS

Figure 1A:
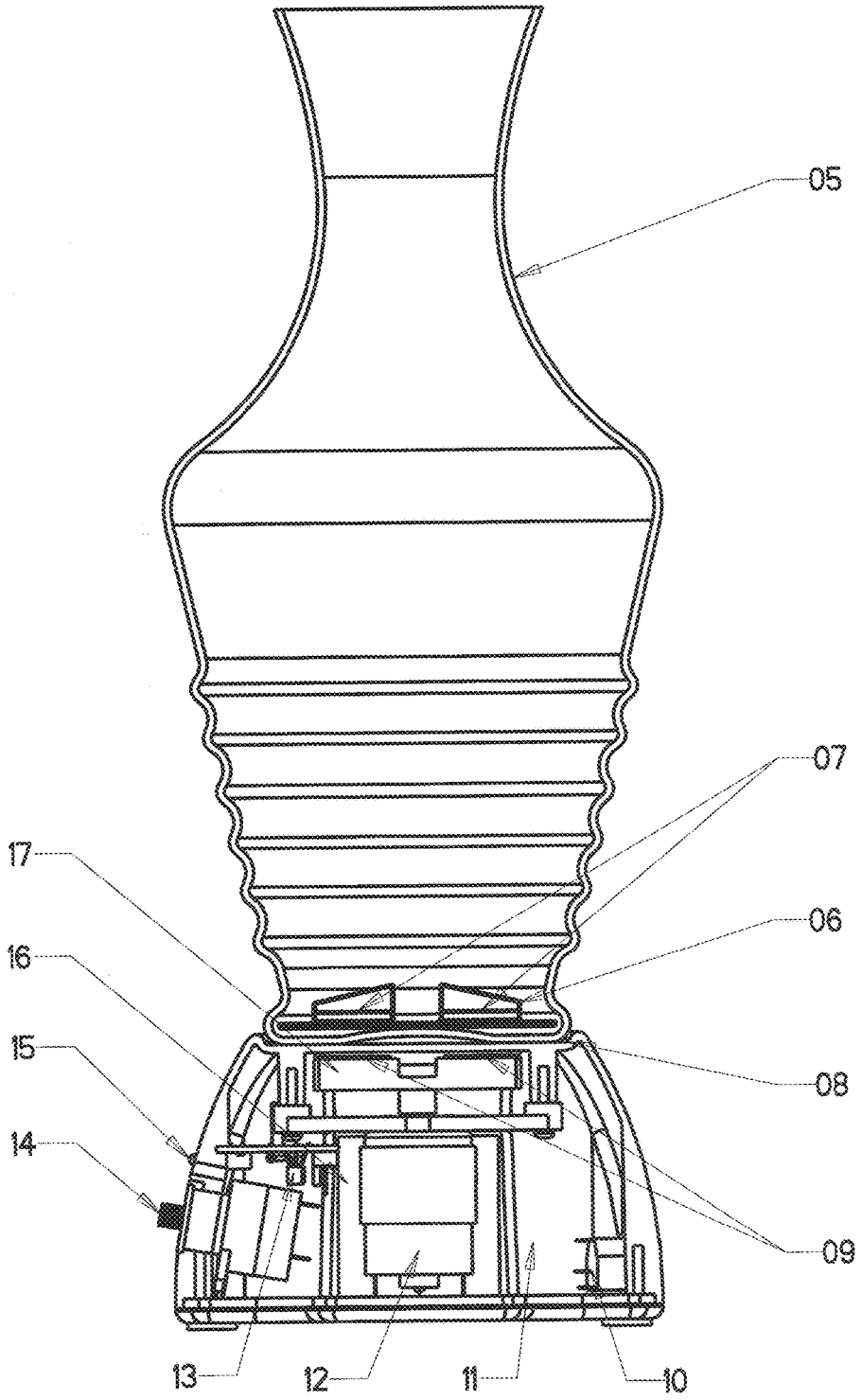
FIG. 1A is a cross section of the front view of an illustrative embodiment of the magnetic stirring system (or "integrated drinking product preparation system") of the present invention in which the base of the vessel includes a convex center section.

The present invention is more fully described hereafter with reference to the accompanying drawings, in which one or more exemplary embodiments of the present invention are shown. However, while construction and utilization of the present invention is best understood through the following text and associated figures, it is to be understood that the invention is not limited to the particular embodiments, materials, methodologies or protocols herein described, as these may vary in accordance with routine experimentation and optimization. Many such adaptations, variations, modifications, and equivalent arrangements are contemplated and thus implicitly disclosed by the embodiments described and fall within the scope of the present invention.

It is also to be understood that although specific terms are employed herein for the purpose of describing particular illustrative embodiments, they are used in a generic and descriptive sense only and not for the purpose of limitation and are intended to limit the scope of the present invention, which will be limited only by the appended claims. Unless otherwise expressly defined, such terms are to be afforded their broad ordinary and customary meaning, as commonly understood by one of ordinary skill in the art and not inconsistent with that applicable to the relevant industry and without restriction to any specific embodiment hereinafter described. In case of conflict, the present specification, including following definitions, will control.

The words "a", "an", and "the" as used herein mean "at least one" unless otherwise specifically indicated. Where only one item is intended, the term "one", "single" or similar language is used.

When used to join a list of items, the term "or" denotes at least one of the items, but does not exclude a plurality of items of the list.

In the context of the present invention, the term "proximal" is used to refer to an end, portion, or direction that is situated closest to or points to the user. In contrast, the term "distal" is used to refer to that end, portion, or direction that is situated farthest away or points away from the user.

In the context of the present invention, the terms "axial" and "longitudinal" are used to refer to travel along a long axis of a component, i.e., a lengthwise direction or dimension. In contrast, the term "lateral" is used herein to refer to travel perpendicular or transverse to a long axis of the component, i.e., a side-to-side direction or dimension.

In the context of the present invention, the term "radial" is used to refer to the direction that extends outward from the center of a circular or tubular structure or inward from the circumference inward along a radius.

In the context of the present invention, the term "groove" is used herein to refer to long, narrow concave furrow or channel bordered by one or more corresponding projecting (i.e., convex) "ribs", "ridges" or "flanges" disposed about the periphery of the vessel.

In the context of the present invention, the magnetic stirring system for wine aeration of the present invention is at times referred to as an "integrated drinking product preparation system", both of which encompass any device that includes of a fully integrated magnetic stir plate and vessel with a captive impeller and speed control system, which is used to aerating wine for human consumption.

Within the practice of the present invention, the phrases "stir plate" and "magnetic stir plate" are alternatively used herein to refer to a magnetic stirrer that employs a rotating magnetic field to cause a captive magnetic stirring impeller to spin very quickly within a vessel for the purpose of aerating wine. A preferred magnetic stir plate is capable of providing mixing speeds from zero revolutions per minute (rpm) to a maximum speed ranging from 800 rpm to 2400 rpm.

Within the practice of the present invention "coupling magnets" refers to two magnets within the magnetic stir plate that drive the captive magnetic stirring impeller via magnetic coupling.

Within the practice of the present invention "coupling" or "magnetic coupling" refers to an overlapping magnetic force between the magnetic stir plate's coupling magnets and the captive magnetic mixing impeller's magnets.

Within the practice of the present invention "decoupling" refers to breaking the magnetic coupling force between the magnetic stir plate's coupling magnets and captive magnetic stirring impeller.

Within the practice of the present invention, the phrase "captive magnetic stirring impeller" refers to a device that is retained within the base of a vessel, preferably just above the bottom surface of the vessel so as to reduce noise and friction, and rotated within the horizontal plane via magnetic coupling to the magnetic stir plate's coupling magnets. In the context of the present invention, the captive magnetic stirring impeller comprises a relatively thin, flat (i.e., planar) central support component having transverse "wing" components disposed at opposite ends and further including one or more vertically extending "blade" components therebetween.

The shape of the impeller is largely a matter of design choice; preferred options include, but are not limited to rectangular, ovoid and other polygonal configurations. Likewise, the impeller may include a plurality of, preferably an even number, more preferably 2-6, "arms" that extend radially from a center point and terminate in the requisite transverse wing component.

The shape of the wing(s) and the blade(s) is also largely a matter of design. As noted in greater detail below, the captive magnetic stirring impeller is designed to nest snugly at/in the base of the vessel. Thus, in a preferred embodiment, the wings have an arcuate or crescent shape so as to match the rounded shape of the vessel base. As for the blade(s), in that they function primarily as "fins" that induce the requisite vortex, they preferably have a triangular, rhomboid, trapezoidal or other regular polygonal form. While the blades are depicted herein as perpendicular to the central slat, alternate embodiments contemplate a pitch away from the vertical axis, +/−5 to 45 degrees, more preferably 5 to 30 degrees, more preferably 5 to 10 degrees.

In the context of the present invention, the "attachment" of the captive magnetic stirring impeller to the base of the vessel occurs via a "snap fit", wherein the "wings" of the impeller coordinate with a peripheral rib defined by a lateral groove disposed about the periphery of the vessel, at or near the base of the vessel. In a preferred embodiment, the impeller is "snapped" into the vessel by the manufacturer and thus an integrated magnetic stirring vessel is provided to the consumer.

In one preferred embodiment, the underside of the captive magnetic stirring impeller may be provided with integral boss or button that establishes a small clearance between the base of the vessel and the bottom of the impeller. In an alternate embodiment, the base of the vessel may be provided with a centrally disposed convex surface that serves the same purpose as the boss or button, namely to establish a clearance between the spinning "wings" and the base of the vessel. Both configurations essentially eliminate friction, and thus friction-associated wear out, and further allow for more the formation of a more effective and efficient vortex.

As noted above, the overall size and shape of the captive magnetic stirring impeller, as well as its constituent components, is largely a matter of design choice that will vary directly with the dimensions of the corresponding vessel, particularly the diameter and volume. Most critically, the captive magnetic stirring impeller must be of a size and shape to firmly "nest" within a peripheral rib provided in, at or proximate to the base of the vessel and yet still be permitted spin without impediment. Accordingly, the "maximum dimension" of the impeller (i.e., a diameter measured from "wing" to "wing", designated in FIG. 4A as approximately 73.5 mm) is preferably slightly larger than the diameter of the vessel measured at a lowermost lateral groove (depicted in FIG. 2B as "dT"), such that the impeller is firmly held within a peripheral rib disposed at the lowermost portion of the vessel between the base and the lowermost lateral groove, and yet slightly smaller than the diameter of the vessel measured at the base of the vessel (depicted in FIG. 2B as "dW"), such that the impeller may spin freely in the lowermost portion of the vessel, proximate to the base of the vessel.

In a preferred embodiment, the captive magnetic stirring impeller is optimized to have a maximum dimension of between 3 and 10 cm and (or about 1.5 and 4 inches), more preferably between 5 and 7.5 cm (or about 2 and 3 inches), more preferably on the order of 6 to 7 cm (or about 2.5 to 2.75 inches). As flexibility is critical to the lateral snap-fit, the captive magnetic stirring impeller is optimized to be very thin, having a overall thickness of less than 25 mm (or around 1 inch), more preferably less than 12-13 mm (or around 0.5 inches), more preferably less than 6-7 mm (or around 0.25 inches), more preferably on the order of 2 mm (or around 0.08 inches). Preferred shapes for the magnetic stirring impeller are presented in FIGS. 4A-4E.

Figure 6A:
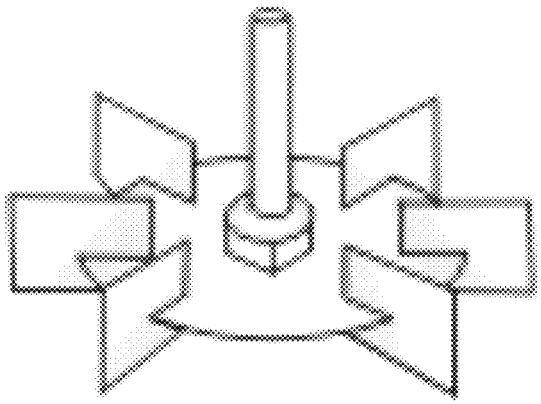
FIG. 6A (Prior Art)
FIG. 6A-6C present various radial impeller configurations including the Rushton-type (FIG. 6A), the pitched blade type (FIG. 6B), and the hydrofoil type (FIG. 6C).
Figure 6B:
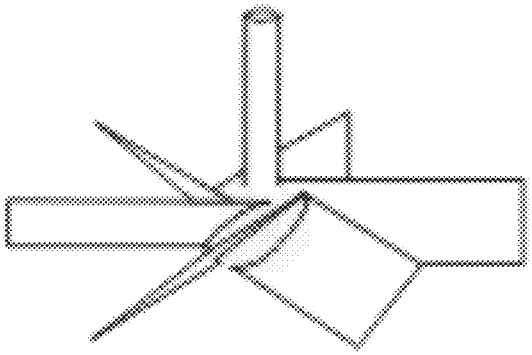
FIG. 6B (Prior Art)
Figure 6C:
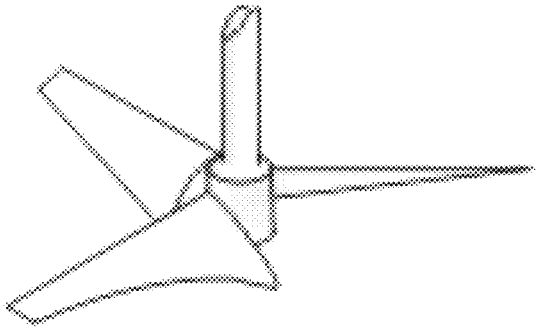
FIG. 6C (Prior Art)

In addition, the captive magnetic stirring impeller must be of a size and shape sufficient to give rise to a vortex of adequate surface area so as to allow for efficient and effective aeration. Through empirical testing, radial impellers of the so-called "Rushton turbine" type (see FIG. 6A), characterized by a central slat portion comprised one or two or more radially extending "arm" components (preferably an even number between 2 and 8, more preferably between 2 and 4) and an equivalent number of vertically-extending blade components (preferably an even number between 2 and 8, more preferably between 2 and 4), were identified as creating the most efficient vortex. Alternate radial configurations such as depicted in FIGS. 6B and 6C are also contemplated. The length of each "arm", which is effectively a radius of the base, will vary directly with the overall dimensions of the impeller and associated vessel; likewise, the length of each transverse wing will vary with the number of arms utilized. While wing length is mostly a matter of design choice, arm length is a critical factor in determining vortex efficiency as wings that are spaced farther apart can more efficiently create a powerful vortex that similarly sized wings that are closer together. In other words, vortex power and efficiency are directly proportional to the maximum dimension of the impeller.

In an illustrative embodiment, the impeller is characterized by relatively planar rectangular base, characterized by two "arms" extending from a center point and terminating in two arcuate "wings" (each symmetrically disposed about the end of each arm), and two triangular shaped blades. In a preferred embodiment, the ratio of blade span (i.e., a length measured from blade end to blade end, designated in FIG. 4B as approximately 52 mm) to the blade height is optimized to range from 5:1 to 3:1, more preferably around 4:1. For example, the blade height is preferably on the order of 10-20 mm, preferably 10-15 mm, more preferably 10-11 mm while the blade span ranges from 30-50 mm, preferably 35-45 mm, more preferably 40-45 mm. While less critical, in the context of a two-winged system, wing length that ranges from 30-50 mm, preferably 35-45 mm, more preferably 40-45 mm.

The captive magnetic stirring impeller is preferably molded from a plastic or polymer material, more preferably one that is FDA approved for food use, has a low modulus of elasticity and a low coefficient of friction. For example, preferred polymers have a Young's modulus of less than 10, more preferably less than 1, more preferably less than 0.1 GPa. Particularly preferred are acetal homopolymers, such as those sold under the tradename Delrin®, that offer an excellent balance of properties to bridge the gap between metals and plastics. In particular, Ensinger's Delrin® 150, a homopolymer acetal manufactured using DuPont Delrin 150 Resin, possesses high tensile and flexural properties, along with creep resistance and toughness, while exhibiting low moisture absorption, and fatigue endurance.

The captive magnetic stirring impeller is designed to carry or contain a magnetic, paramagnetic or ferromagnetic material to couple with the field of the coupling or drive magnets of the magnetic stir plate. In a preferred embodiment, ceramic and rare earth magnets are installed within the body of the captive magnetic mixing impeller. In a further preferred embodiment, two or more ceramic or rare earth magnets, for example fully magnetized Neodymimium (NdFeB) magnets, are encapsulated within the captive magnetic stirring impeller, for example, insert molded inside an injection molded impeller. For safety purposes, the magnets should be completely encapsulated with a minimum wall thickness of 1-2 mm all around.

The resultant magnetic fields of the magnet contained within the impeller optimally overlap with the magnetic fields of the magnetic stir plate's coupling magnets. In yet another embodiment, the two-impeller magnets within the captive magnetic stirring impeller have a vertical magnetic field vector sum. Thus, the impeller has two magnets wherein the summed magnetic field vectors of each magnet are vertical. Preferably, the summed magnetic field vectors of the two captive magnetic stirring impeller magnets are vertical and in opposing directions, namely up and down. This configuration optimizes the field overlap with the magnetic stir plates coupling magnets.

Within the practice of the present invention "stirring vessel" refers to a wine decanter vessel with a captive impeller that is physically attached to the bottom center of the vessel. The vessel is an integrated component of the magnetic stirring system for aerating wine. Vessels can be of various sizes and shapes, which give different stirring characteristics. The main purpose for the vessel is to function as a stirring vessel. The second one is a multi-purpose storage and serving vessel. While the size and shape of the vessel is largely a matter of design choice, for consumer use purposes, preferred embodiments should scaled to accommodate conventional (e.g., 750 ml) and/or oversized (e.g., 1.5-3.0 L) wine bottles. As a vortex can cause shift in volume, the vessel should be afforded a modicum of "headspace" beyond the liquid volume to avoid spillage. In a preferred embodiment, the ratio of height to diameter (either maximum diameter or average diameter) for the vessel ranges between 2:1 and 4:1, more preferably around 3:1. Typically, the height of the vessel will range from 20 to 40 cm, preferably from 20-30 cm, more preferably from 25 to 27 cm. In a preferred embodiment, the diameter of the vessel will vary along the height, gradually widening from the stable, relatively planar base (characterized by a diameter on the order of 5-10 cm, preferably around 7 to 8 cm) to a maximized hip portion (characterized by a diameter on the order of 10-15 cm, preferably around 12-13 cm) and then tapering to a narrowed neck portion (characterized by a diameter on the order of 3-6 cm, preferably around 4-5 cm) and optionally including a flared lip or spout (characterized by a diameter on the order of 5 to 9 cm, preferably around 7-8 cm). Aspect ratios are significant factors in specifying the vessel's agitation requirements. These rough vessel dimensions show excellent mixing and vortex dynamics.

For both aesthetic and functional reasons, glass is a classical choice of material to use for aerating wine. Accordingly, in the context of the present invention, the vessel is preferably clear or transparent, preferably fabricated from glass using a blow-molding process that can produce hollow parts with very complex shapes. Polycarbonate and acrylic materials are also contemplated, as is "tempered glass", also known as safety glass, a glass is strengthened through thermal or chemical treatment.

As for the shape, the vessel must necessarily include at least one exterior groove disposed about the periphery, preferably at or proximate to the bottom or base of the vessel that defines a peripheral rib below that retains the captive magnetic stirring impeller. To ensure proper fit, the dimensions of the peripheral rib should match closely with the dimensions of the captive magnetic stirring impeller. In a preferred embodiment, one or more additional ribs and grooves may be disposed about the vessel, between the base (at the bottom) and the neck (at the top), more preferably between the base and the hip portions. While primarily contributing to aesthetics, providing a series of ribs and grooves in a lower half, more preferably a lower third of the vessel, appears to contribute to efficient vortex formation. The number and spacing of the optional grooves is primarily a matter of design choice; for example, a vessel may have 4-8, more preferably 4-6 ribs defining a corresponding number of grooves, preferably relatively equally spaced apart, typically on the order of 10-15, more preferably 12-13 mm apart.

In a preferred embodiment, the base of the vessel, or at least its periphery, is relatively planar so as to ensure upright stability. However, in certain preferred embodiments, particularly those fabricated through blow molding, the base may include a convex center section. In either case, base should be dimensioned to a diameter nest within or coordinate with the positioning component(s) of the stir plate.

The remaining features are largely a matter of design. For example, the top opening should be wide enough to accept the spout of conventional wine bottle yet narrow enough to prevent the contents from spilling or sloshing out during operation. In a preferred embodiment, the neck portion is tapered to allow for easy gripping and the base portion is widened to accommodate the volume and act as a stabilizer. Thus, the vessel may take the form of a conventional carafe, decanter or flask, comprised of a relatively flat or planar bottom, a relatively conical, ovoid, or rounded body that tapers back to a relatively long and cylindrical neck portion. The opening may optionally be provided with a slight lip adapted to mate with an optional closure mechanism, such as a rubber, glass or acrylic stopper, useful for storage purposes.

A principal object of the present invention is to provide an improved acceleration and deceleration control system for the DC motor to avoid the disadvantages and difficulties of speed control of the prior art. Accordingly, within the practice of the present invention "acceleration and deceleration control system" refers to a specifically designed algorithm embedded into a microprocessor to automatically control the rate of speed of the DC motor. The selected algorithm may vary according to the size, character and varietal of wine selected.

In a preferred embodiment, the control system utilized is a DC power of the electronic control systems. Thus, the magnetic stir plate is fitted with a DC power jack capable of receiving power from a low voltage DC power source. In a preferred embodiment, alternating current (AC) power is transformed to DC power from a wall-mounted transformer. In this embodiment, no AC power reaches the stir plate itself, thereby reducing the possibility and severity of electrical shock. However, in an alternate embodiment, the magnetic stir plate may be powered from an appropriate battery source.

In the preferred embodiment, a microcontroller is mounted to a PC circuit board that is integrated into the magnetic stir plate. More particularly, PC board is preferably attached inside the stir plate and held in place by appropriate housing components. In an illustrative embodiment such as depicted FIG. 7, the PC board 29 includes a first connector 31 having a first set of pins (32, 33) for power input, for example that communicate with a 9V wall charger (not shown), and second set of pins (34, 35) for power output, for example that communicate with and power the DC motor 12; a second connector 27 that connects with and charges the optional battery pack 16 as well as an optional temperature sensors (not shown); and a third connector 28 that connects with the actuator mechanism, such as push button 14 in FIG. 1A or potentiometer knob 40 in FIG. 1B).

The microcontroller accepts data input from the linear speed control interface. The data is processed by the microcontroller and the appropriate action is taken according to the programmed commands. The preprogrammed microcontroller governs the action of the motor and as well as the display components. In an alternate embodiment, the microcontroller may be mounted on a PC board. One or more actuating mechanisms, such as a switch, lever, or push button, are preferably mounted to the front of the stir plate, along with appropriate display components, such LED screen or dual green/red LED lamp. For example, a green light may indicate power is "on" and may start blinking after a selected cycle completes (e.g., in 10 min). The red light indicates when the battery needs recharge.

In the context of the present invention, the PC circuit board is designed for both push button ("Push") and potentiometer ("POT") functioning. There are two programming codes for both Push and POT operations. In a preferred embodiment, a first microcontroller, for example a single-chip microcontroller in Atmel's megaAVR family, such as the Atmega 328p TQFP chip depicted in FIG. 7 as element 36, constitutes the main microcontroller for the circuit while a second microcontroller, for example an NiMH battery pack charging controller as exemplified by the DS2715 chip, is used for power management and battery charging.

In a preferred embodiment, the control system of the present invention is designed to address three major aspects, namely:

1. Speed Adjustment

A PWM (Pulse Width Modulated) signal may be used to control the speed of the motor. This PWM signal may be generated by the microcontroller Atmega328 TQFP chip. The width of the pulse is directly proportional with the speed of the motor; so it can easily change the speed by varying the width of the pulse.

In a preferred embodiment of the present invention, the microcontroller chip has a Digital to Analog (DAC) converter section. In the context of the present invention, the DAC function is used to obtain the variable rotation speeds. This DAC output operates the power transistor that is in turn used to drive the motor.

2. Battery Charging Management System

Figure 7:
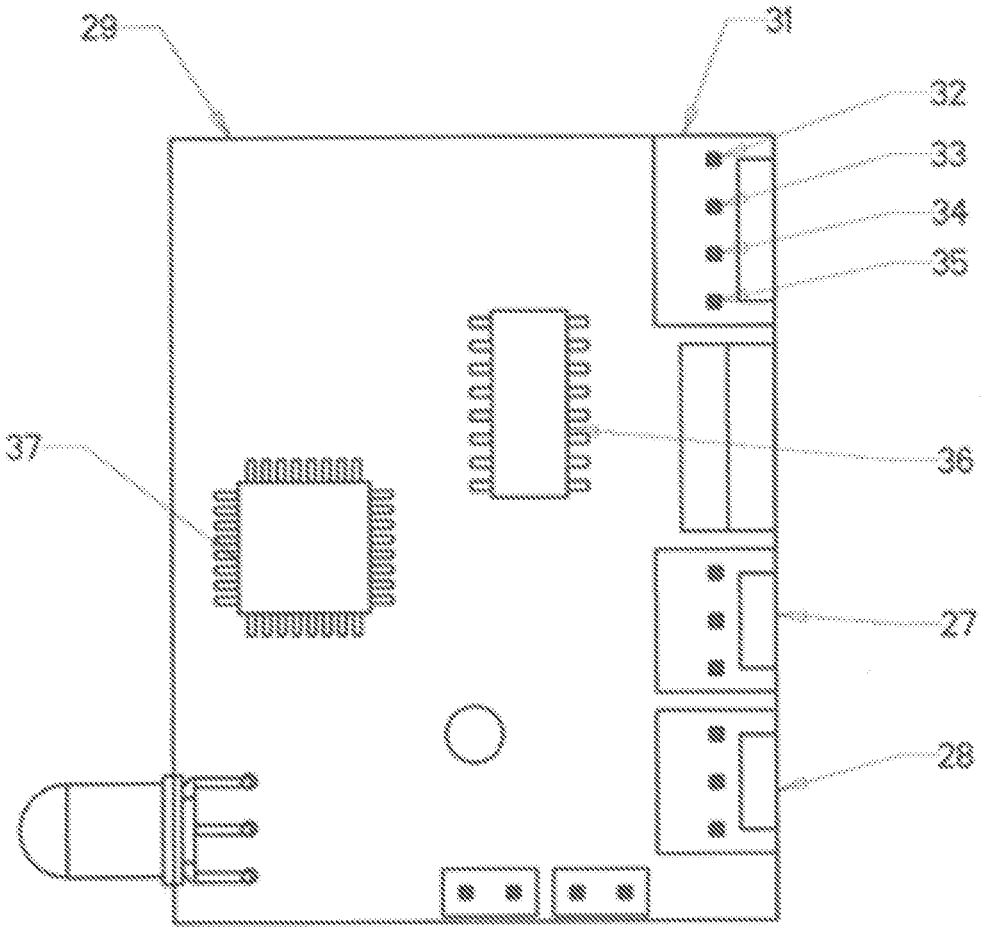
FIG. 7 is a line drawing of an optional circuit board suitable for controlling the speed of the motor of the magnetic stirring system of the present invention.

A DS2715 IC, such as depicted in FIG. 7, element 37, may be used to manage the battery pack charging section of the circuit. The DS2715 is well suited for "smart" charge applications for NiMH cells. This chip is designed for reliable safe charging and it works as a switching charger. When the battery is fully charged, it is monitored by one of the contacts of the charger chip. In addition, a low battery level may be identified by measuring the voltage of the battery pack. This measurement is taken by a voltage divider part of the circuit. A user selectable charge timer allows charge rates from 0.167 C to 2 C. FAST-CHARGE, TOPOFF and DONE modes are included for the highly reliable, safe charging of NiMH cells.

3. Potentiometer or Push Button Controlling System

In the context of a potentiometer circuit, there is an inbuilt power switch. By way of example, if the dial is rotated, for example to a left side corner, the circuit will be power off. If the dial is turned to the right, for example, in a clockwise direction, the circuit is activated, the motor turn on and the LED flash with green color indicating that the device is "in use". The speed of the motor can be changed according to the rotated angle of the POT. In the context of the present invention, after a pre-determined period of time has elapsed, for example a 6-12 minute, more preferably a 7-10 minute time period, the motor turns off automatically. Next, the LED may start to blink. Until the motor is started by rotating the POT, this LED will be blinking. If the battery is low when operating or LED blinking conditions, the LED color changes to RED and will continue to blink until the charger is plugged in.

Figure 5A:
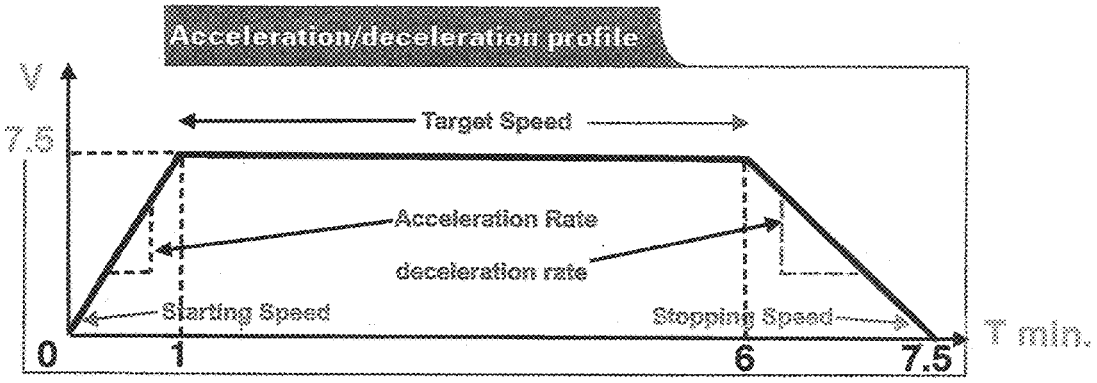
FIG. 5A is a diagram of an illustrative asymmetric acceleration/deceleration control profile that may be programmed into the microcontroller of magnetic stirring system of the present invention.
Figure 5B:
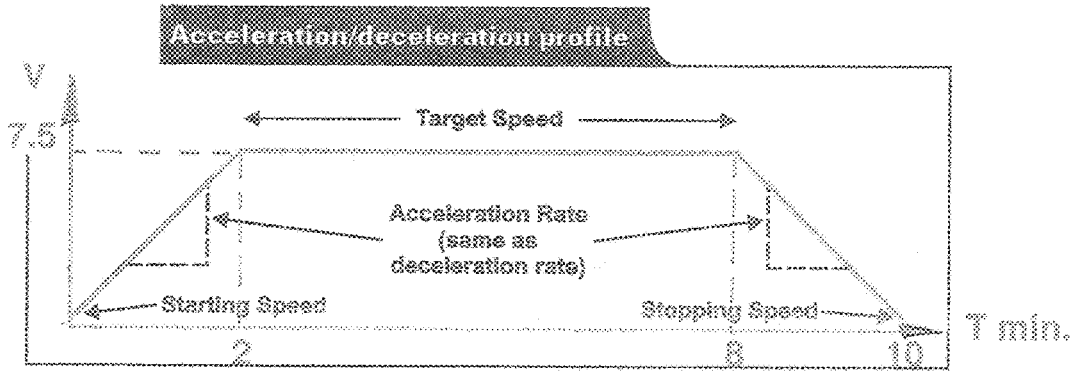
FIG. 5B is a diagram of an illustrative symmetric acceleration/deceleration control profile that may be programmed into the microcontroller of magnetic stirring system of the present invention.

In the context of a push button circuit, there is no potentiometer to manually adjust the speed. Rather, the device is characterized by one or more pre-programmed speed profile(s), each of which may be optionally optimized for a particular wine types. For example, one may simply press the push button associated with a desired wine varietal, at which point the motor will rotate according to a pre-determined speed profile, examples of which are depicted in FIGS. 5A and 5B. As noted therein and elsewhere, the speed algorithm may be symmetrical or asymmetrical.

The push button controlling system automatically starts the program and the PWM output. The output signal is started with a low pulse and slowly and linearly increases the pulse width of the PWM signal until it reaches maximum speed. In one embodiment (such as depicted in F, this will happen within the first 2 minutes, more preferably within the first minute. The pulse width represents the duty cycle of the pulse. In an 8-bit variable, the decimal value can be changed between 0 and 255, so pulse width can be change by assigning 0 to 255 values on the PWM variable.

In the push button embodiment, the LED function is the same as in the POT. A prolonged press, for example more than 3 seconds, will turn off the circuit and power down the machine.

Although any methods and materials similar or equivalent to those described herein can be used in the practice or testing of embodiments of the present invention, the preferred methods, devices, and materials are now described in greater detail by reference to the exemplary embodiments. However, the following examples only illustrate aspects of the invention and in no way are intended to limit the scope of the present invention. As such, embodiments similar or equivalent to those described herein can be used in the practice or testing of the present invention. For example, it should be understood that, although steps of various processes or methods may be shown and described as being in a sequence or temporal arrangement, the steps of any such processes or methods are not limited to being carried out in any particular sequence or arrangements, absent an express indication otherwise. Indeed, the steps in such processes or methods generally may be carried out in various different sequences and arrangements while still falling within the scope of the present invention.

In addition, any reference to advantages, benefits, unexpected results, or operability of the present invention are not intended as an affirmation that the invention has been previously reduced to practice or that any testing has been performed. Likewise, unless expressly stated otherwise, use of verbs in the past tense is not intended to indicate or imply that the invention has been previously reduced to practice or that any testing has been performed.

EXAMPLES

Figure 1B:
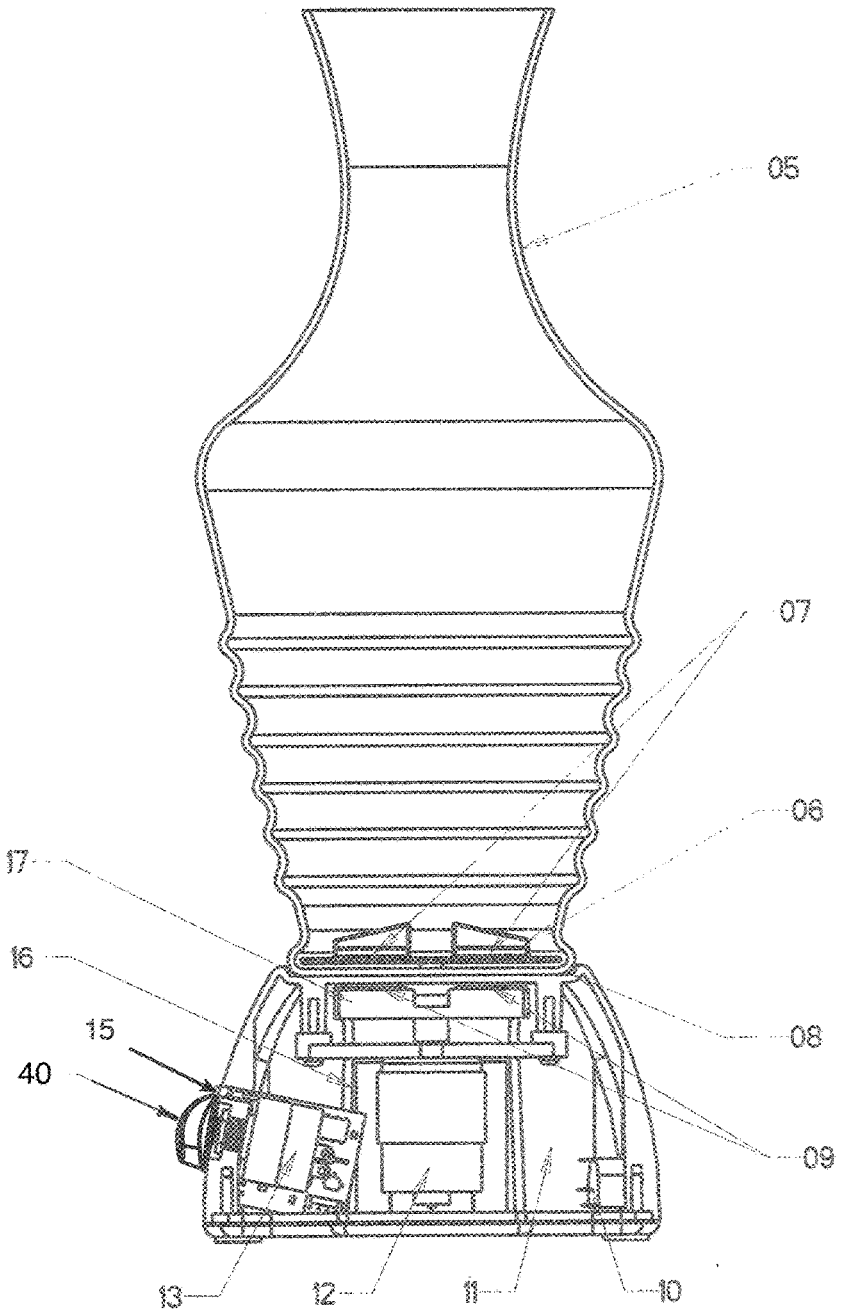
FIG. 1B is a cross section of the front view of an alternate embodiment of the magnetic stirring system (or "integrated drinking product preparation system") of the present invention in which the base of the vessel is flat and the push-button actuator is replaced by a potentiometer knob.
Figure 2A:
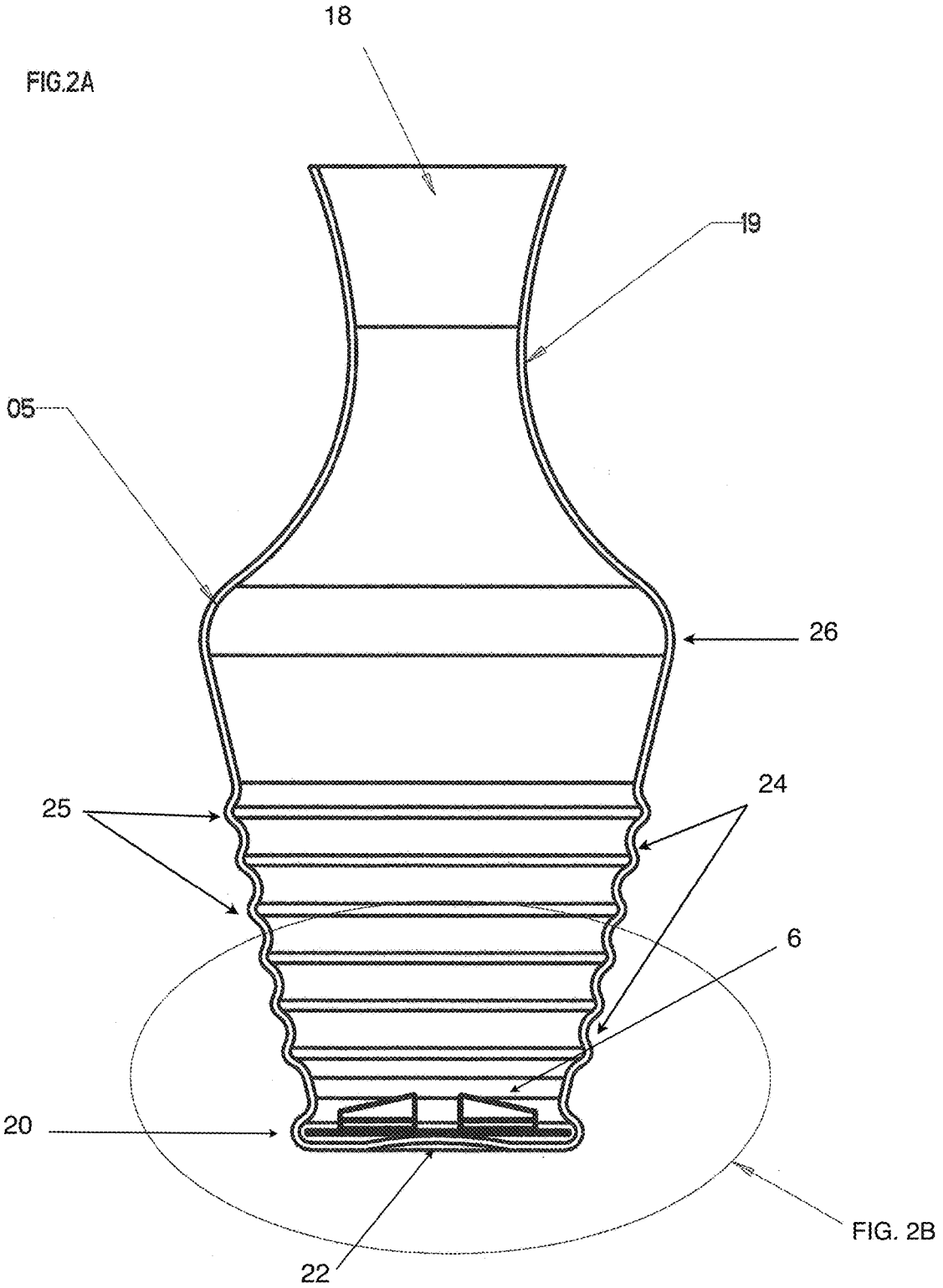
FIG. 2A is a cross section of the front view of the stirring vessel from the embodiment of FIG. 1A in isolation.

A preferred embodiment the magnetic stirring system for aerating wine is shown in FIGS. 1A and 1B. The system, comprised of a magnetic stir plate 11, stirring vessel 05, and a captive magnetic stirring impeller 06, was designed and tested and the components of the system were fully integrated with each other to optimize wine aerating and utility for a home appliance. Referring to FIG. 2A, stirring vessel 05 is characterized by an open top or spout 18, a tapered neck 19, a widened hip 26 and a stable base 20. Expanded views of the base portion, and particularly a captive magnetic stirring impeller 06 characterized by two vertically extending blades 03 affixed thereto, are set forth in FIGS. 2B and 2D.

As discussed in greater detail above, the bottom of the vessel is characterized by "snap-in rib" 30 dimensioned to received and subsequently capture the magnetic stirring impeller 06 as discussed. The vessel may further be provided with a number of "swirl grooves" 24 that define a series of raised ribs or projecting flanges 25. As discussed above, these optional ribs and grooves serve to optimize efficient vortex formation.

Referring to FIGS. 1A and 1B, the magnetic stirring plate 11 has a recessed positioning element 08. The vessel rests within the stir plate's positioning element providing a direct center for all integrated systems. The stir plate further includes a mounted PC board with a microcontroller 13. The speed control interface includes a software algorithm downloaded into the microprocessor, pushbutton switch 14 with LED light 15 to activate the automatic cycle and a dual green/red LED light indicating a power/charge status. Two coupling magnets of opposite polarity 09 are aligned with two molded magnets of opposite polarity 07 into a stirring impeller to optimize magnetic schematic. The coupling magnets 09 are attached to the rotary iron bar 17 and are rotated in a horizontal plane by the DC motor 12. A DC power jack 10 can accept power from an AC wall mounted adapter (or other adapter such as a car adapter) or battery pack 16.

In a related embodiment, the magnetic stir plate is designed with a positioning element that aligns the vessel on the stir plate, thereby greatly improving the stability of the vessel. Furthermore, the positioning element assures the magnetic field overlap of the mixer's coupling magnets and the captive magnetic stirring impeller is thus optimized.

In a preferred embodiment, decoupling is greatly reduced through the physical attachment of the captive magnetic stirring impeller 06 to the base 20 of the vessel 05 using the above-described snap-in method. Unlike stir bars that can often be easily decoupled, the outside diameter of the impeller is restricted of all movements except the rotational movement required inside the vessel. This innovation dramatically reduces decoupling when compared to the traditional stir bar design. In the embodiment depicted in FIGS. 4D and 4E, the impeller is provided with a small diameter bottom boss 21 on which it rotates above the bottom surface of the vessel, thereby reducing the friction and noise associated with traditional magnetic stir bars. In an alternate embodiment depicted in FIGS. 4A-4C, the requisite lower clearance is established by a convex dimple 22 on the vessel and thus the boss may be eliminated.

In the related embodiment, decoupling is greatly reduced through the acceleration ramp programmed into the microprocessor, which gradually winds-up the speed of the motor. When a stirring impeller rotates in the fluid, it generates a combination of flow and shear. The impeller generated flow can be calculated with the following equation:

$$Q=Fl*N*D$$

Impeller Diameter, "D" is the maximum diameter swept around the axis of rotation. Rotational Speed, "N" is usually measured in (RPM). This variable refers to the rotational speed of the impeller.

The power required to rotate an impeller can be calculated using the following equation:

$$P=Pop*N3*D5\text{–Turbulent regime}$$

In both equations rotational speed "N" is a decisive factor in the transition from a fluid statics phase (liquid at rest) to gradually increasing liquid velocity and steering energy, thus greatly reducing a potential for magnetic decoupling.

In a preferred embodiment, the captive magnetic stirring impeller is physically attached to the vessel through a snap-in method. The physical integration of the captive magnetic stirring impeller into the vessel eliminates any possibility of the impeller falling out upon pouring the liquid contents. This is a significant improvement for the home consumer in order to prevent the possibility of choking on or losing the stir bar.

Figure 2B:
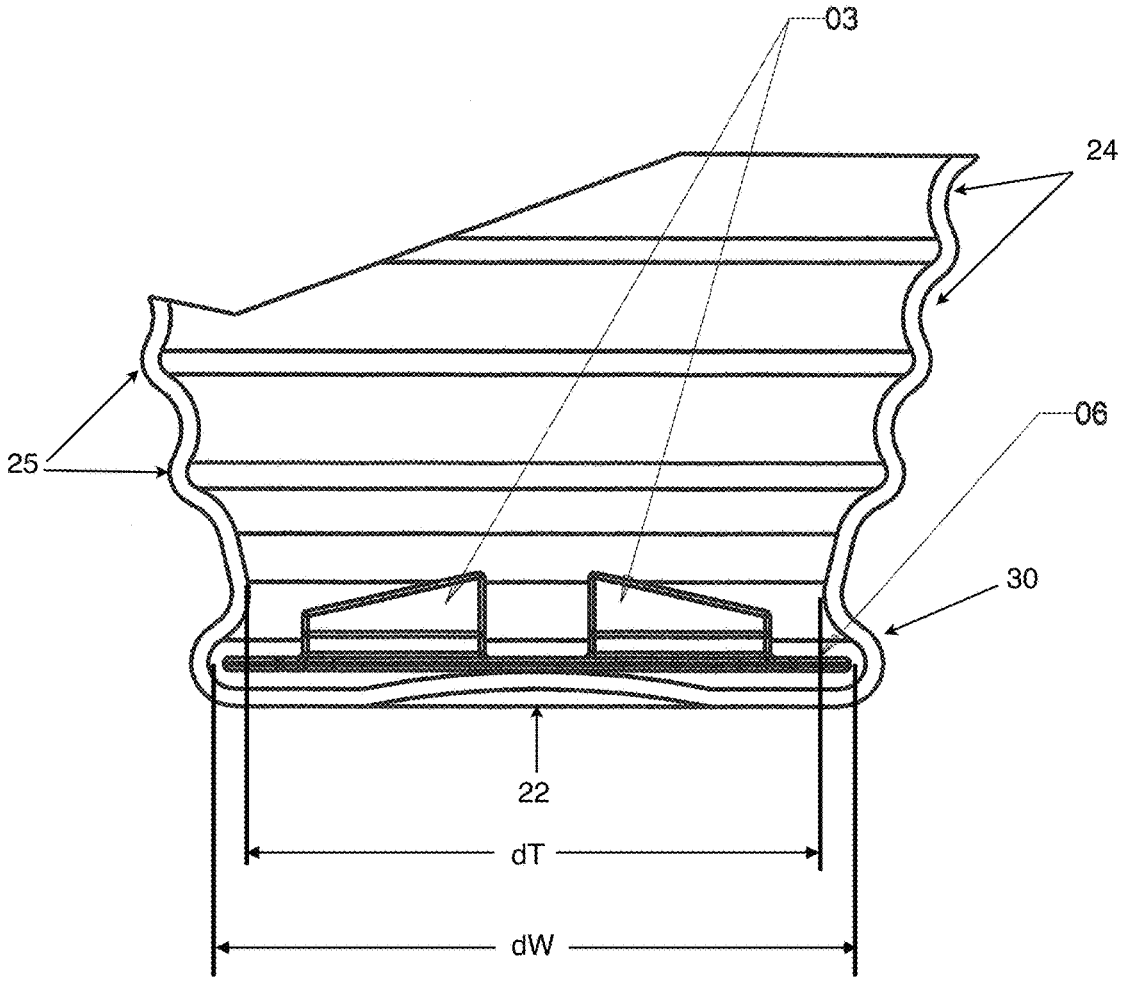
FIG. 2B is an expanded view of the circled section of FIG. 2A, including an expanded cross-section view of the stirring vessel and captive magnetic stirring impeller from the embodiment of FIG. 1A.
Figure 2C:
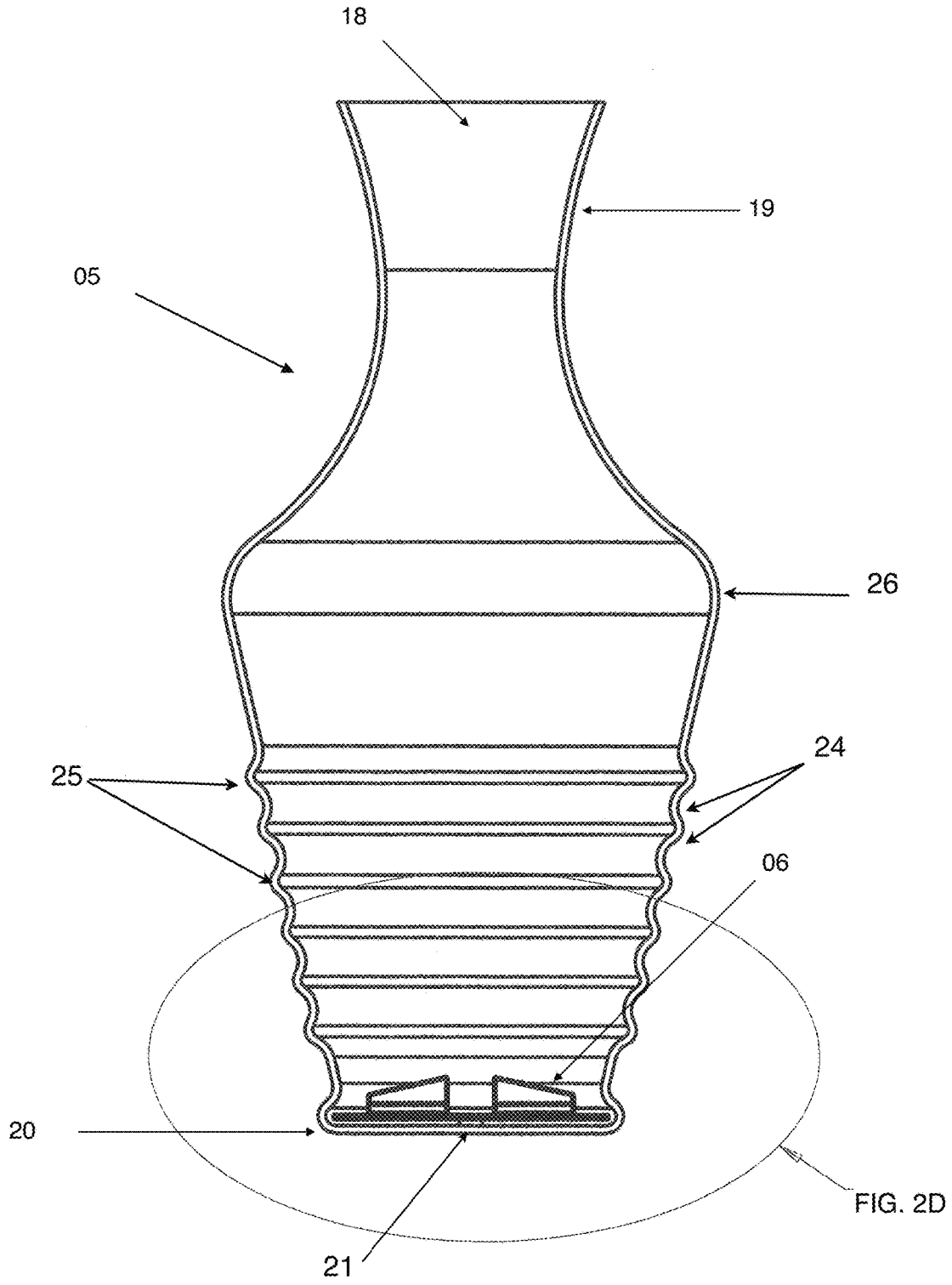
FIG. 2C is a cross section of the front view of the stirring vessel from the embodiment of FIG. 1B in isolation.
Figure 2D:
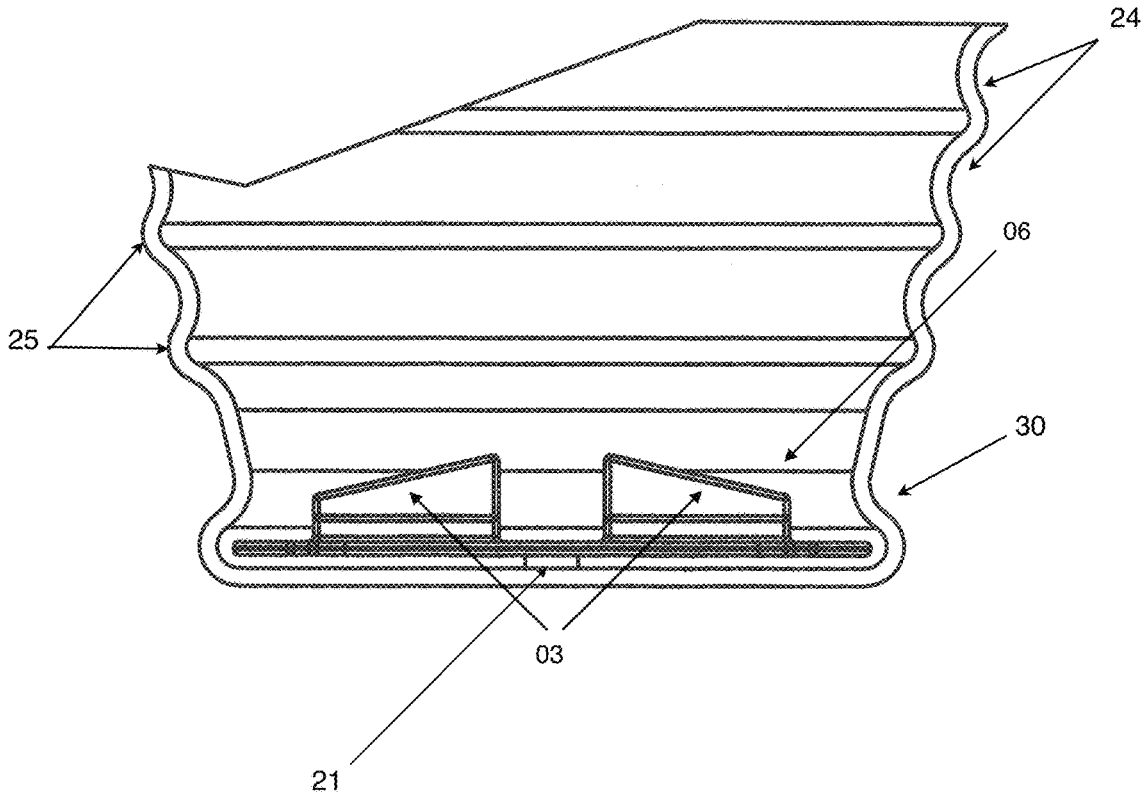
FIG. 2D is an expanded view of the circled section of FIG. 2C, including an expanded cross-section view of the stirring vessel and captive magnetic stirring impeller from the embodiment of FIG. 1B.
Figure 3A:
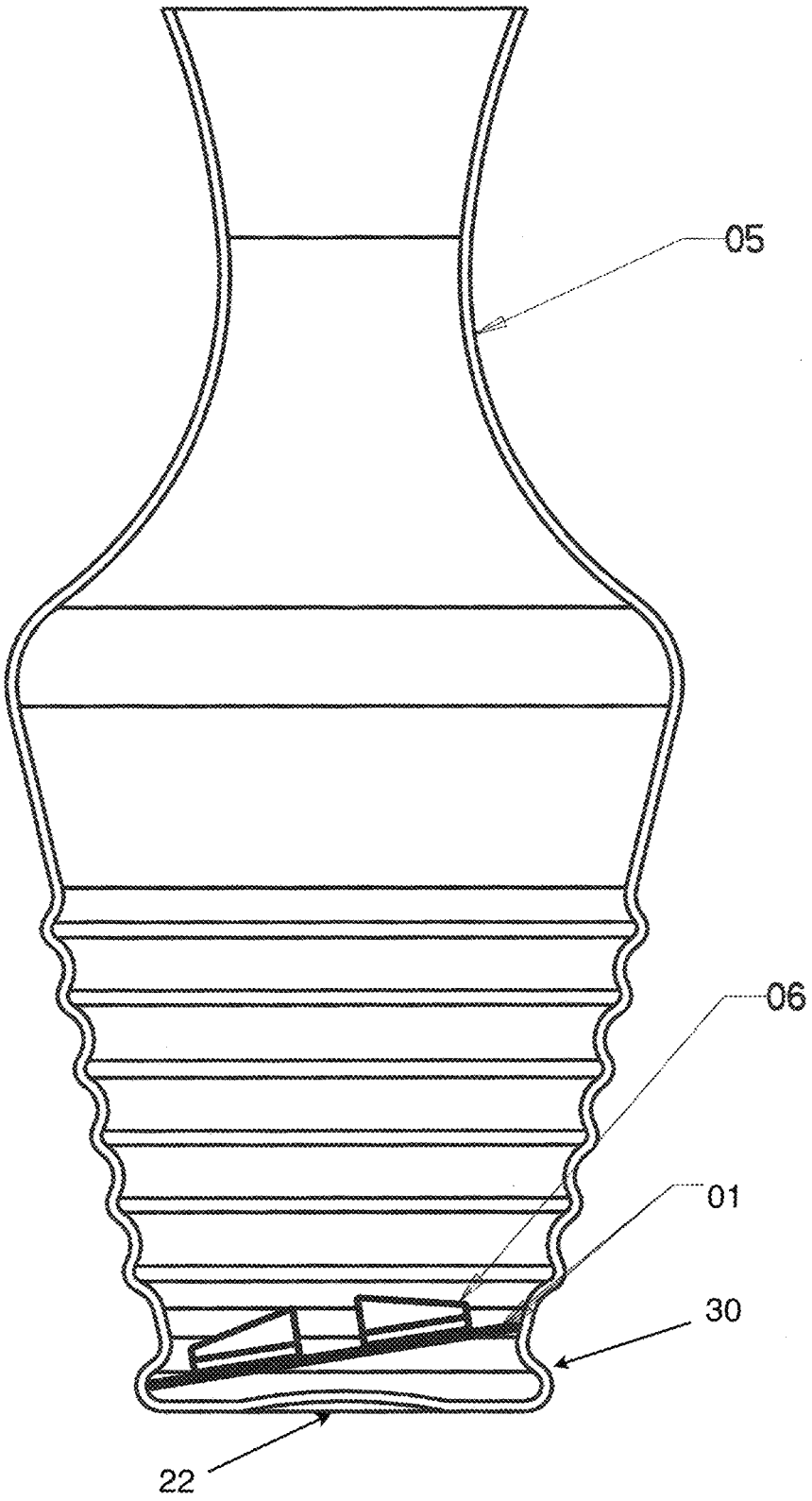
FIG. 3A is a cross section of the front view of the stirring vessel from the embodiment of FIG. 1A in isolation, depicting the snap-fit mechanism by which the magnetic stirring impeller is mounted into a peripheral rib disposed at the base of the stirring vessel.
Figure 3B:
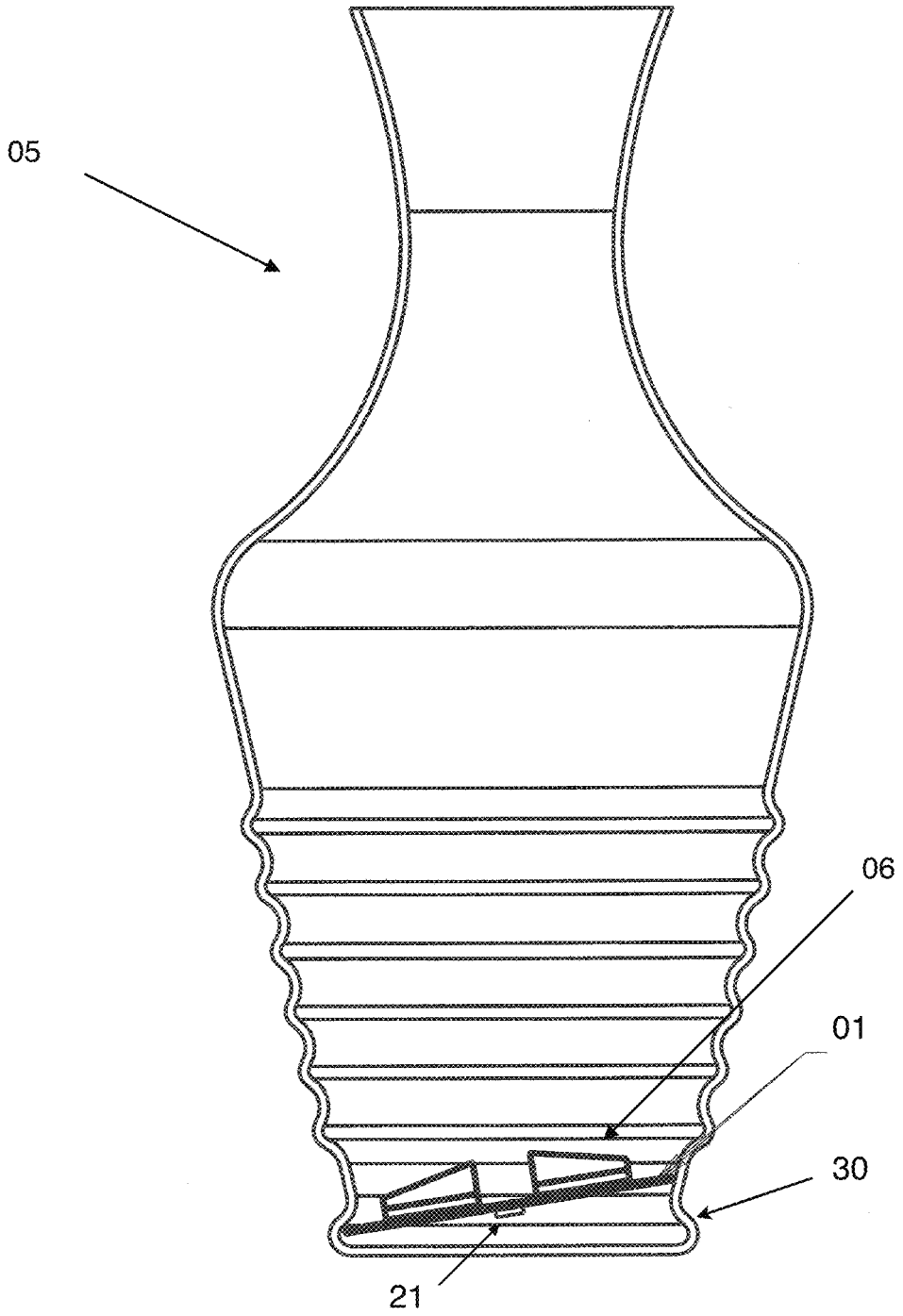
FIG. 3B is a cross section of the front view of the stirring vessel from the embodiment of FIG. 1B in isolation, depicting the snap-fit mechanism by which the magnetic stirring impeller is mounted into a peripheral rib disposed at the base of the stirring vessel.

The initial position of the impeller shown in FIGS. 3A and 3B is before snap-in assembly inside the vessel. FIGS. 2A and 2C, and particularly FIGS. 2B and 2D, depict the impeller after it is affixed to interior the vessel. Once applying vertical force to the elevated side of the impeller the snap-in assembly will be completed and the impeller will be able to freely rotate inside the bottom rib 30 in the horizontal plane of the vessel. Using the standard beam equation, one can calculate assembly force and the stress and strain applied during the assembly of the snap-in impeller.

The deflection force and the same assembly force of the impeller can be calculated with the following equation:

Material used: Delrin ® 500P $$F_d = \frac{bh_e^2}{6} \times \frac{E_s \varepsilon}{L}$$

$$F_a = 1.64 \text{ LBS}$$

Where:

| | |
|---|---|
| Y = Beam Deflection | b = Width of beam |
| $h_e$ = Beam thickness at its base | $E_s$ = Secant Modulus |
| μ = Coefficient of friction | α = Assembly angles |
| ϵ = beam fiber strain | $F_d$ = Deflection force |
| $F_\alpha$ = Assembly force | |

Figure 4A:
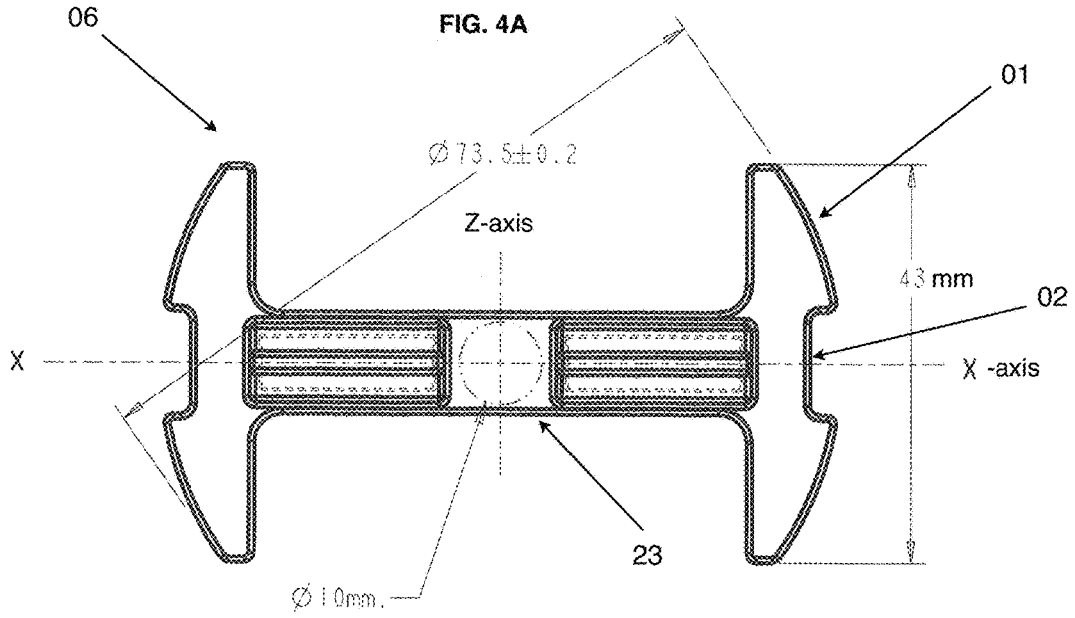
FIG. 4A is a top-down view of the magnetic stirring impeller from embodiment of FIG. 1A in isolation.
Figure 4B:
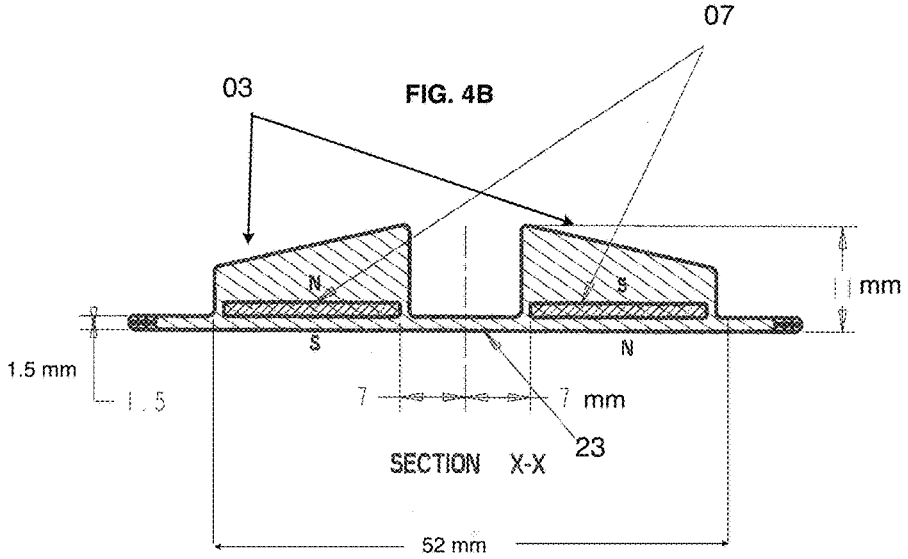
FIG. 4B is a cross-section of a side view of the magnetic stirring impeller from embodiment of FIG. 1A in isolation.
Figure 4C:
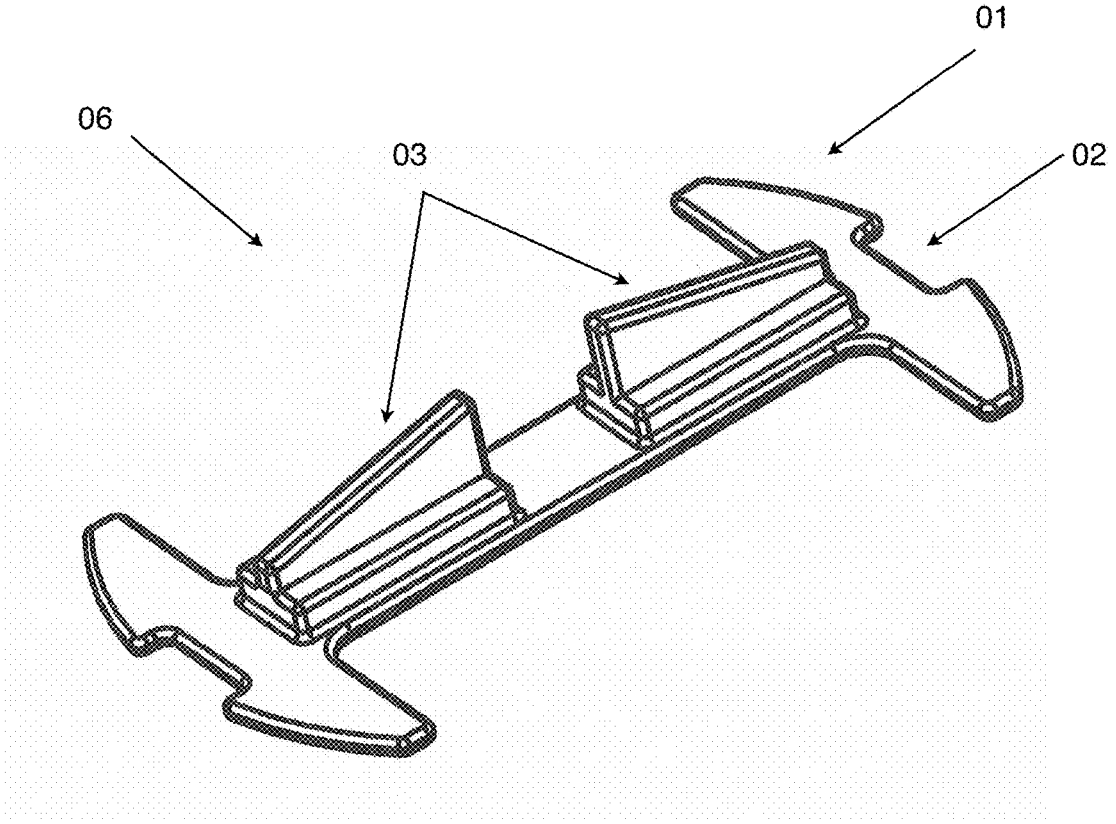
FIG. 4C is a perspective view of the magnetic stirring impeller from embodiment of FIG. 1A in isolation.
Figure 4D:
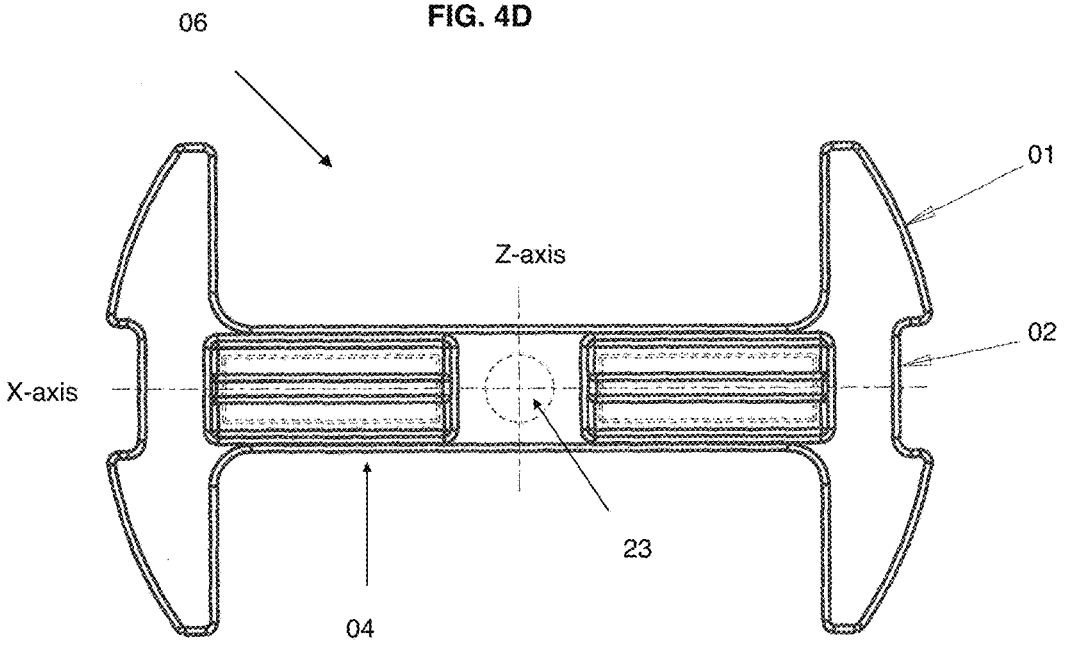
FIG. 4D is a top-down view of the magnetic stirring impeller from embodiment of FIG. 1B in isolation.
Figure 4E:
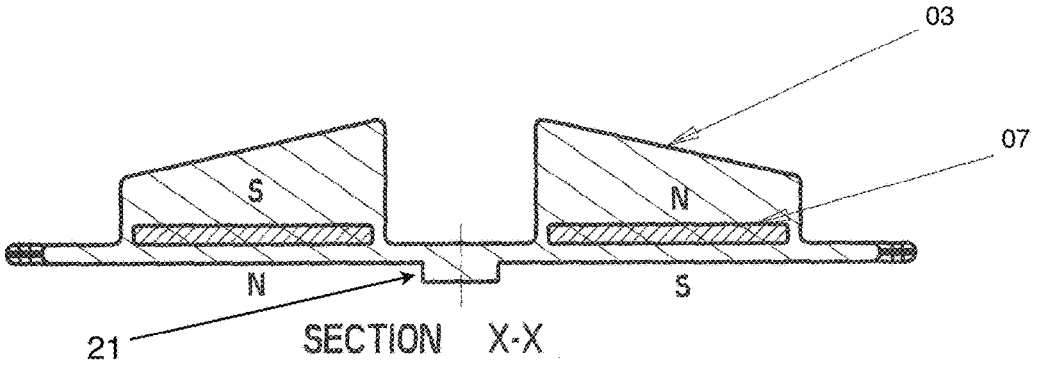
FIG. 4E is a cross-section of a side view of the magnetic stirring impeller from embodiment of FIG. 1B in isolation.

The specifications may be optimized for the size and shape of the captive magnetic stirring impeller. A particularly preferred embodiment depicted in FIGS. 4A 4B, and 4C is suitable for use with blow-molded vessels characterized by a convex dimple 22 at the center. An alternative embodiment, characterized by a lower button or boss 21 such as depicted FIGS. 4D and 4E, is suitable for use with flat-bottomed vessels. In either case, the center 23 of the plastic injection-molded impeller 06 is designed automatically align with the center line of the vessel, which, in turn, is aligned to the center of the magnetic stir plate (and thus the magnetic field established by the rotating iron bar(s) 17) by means of recessed positioning elements 08. In the illustrative embodiments of FIGS. 4A-4E, the captive magnetic stirring impeller is characterized by a relatively linear, preferably rectangular impeller base 04 provided with a pair of laterally extending impeller wings 01, one at each end. Each arcuate impeller wing is optionally provided with a recess or cutout 02 to reduce friction and weight. Stirring impellers typically employ an "open" design and "radial" flow within a mixing vessel. A radial flow sucks in the liquid from axial directions and throws the fluid out in radial directions. The impeller in the present invention is a "radial" impeller, so-called "Rushton turbine", and contains only two vertically extending flat blades 03. Through empirical testing, the specification of the blades form and size was optimized to create the most efficient vortex. A vortex created during the stirring process is very desired because it tends to suck down air into the liquid. In addition, the impeller makes the entire liquid volume in the vessel swirl around as a homogenous body. Both of these conditions are very effective for "turbo" aerating wine. The captive magnetic stirring impeller dimensions also affect the mixing capacity of the system. In turn, the optimal mixing speed is a function of the shape and size of the impeller.

In a preferred embodiment, such as depicted in FIG. 4A-4E the captive impeller has a maximum dimension (measured wing to wing) on the order of 70 mm (or approximately 2.75 inches) diameter and a thickness of about 1.5 to 2 mm (0.06-0.08 inches). The dimensions of the captive magnetic stirring impeller work best with a magnetic stir plate capable of providing mixing speeds from zero revolutions per minute (rpm) to a maximum speed of 800 rpm. The captive magnetic impeller 01 is made from plastic Delrin® 500P. Delrin® (Acetal Homopolymer) is ideal for injection molding parts that require low friction and excellent dimensional stability. Delrin is also FDA approved for use in the food industry.

In a preferred embodiment of the captive magnetic stirring impeller such as shown in FIGS. 4B and 4E, the impeller is comprised of two rare earth NdFeB magnets with a grade of N40SH. The Maximum Energy Product is (BH) max=38-40 MGOe and the Maximum Operating Temperature is 300° F. This very high BHmax makes the magnets suitable to avoid any demagnetization during the insert injection molding manufacturing process with a temperature around 350° F.

FIGS. 5A and 5B illustrate illustrative acceleration/deceleration profiles represented in a Cartesian coordinate system where the abscissa represents the time (T) in minutes and the ordinate is the acceleration voltage DC that is in turn a speed of the motor in RPM. In FIG. 5A, the profile is asymmetric, characterized by 1 minute of acceleration, 5 minutes at target speed, and 1.5 minutes of deceleration.

FIG. 5B presents the profile of an alternate algorithm, the implementation of which provides a pre-configured desired speed. In FIG. 5B, 20% of the total time is selected to accelerate the motor, 60% is selected to run the motor at a constant (reached) speed, and the remaining 20% is selected to decelerate the motor.

The exemplary algorithms depicted in FIGS. 5A and 5B were chosen after setting up a proper blind taste test to avoid subconscious bias among the tasters. The "triangle test", which is a scientifically rigorous way to test, was used to define for a perceptible difference between wines prepared two different ways. Half a bottle of wine was prepared using "turbo" aerating and the other half of the bottle was saved for comparison.

By evaluating the voting records of select wine tasters, it was discovered that 90% of the time the integrated magnetic stirring system of the present invention discovered provided consistent ratings of improvements to a particular wine using this algorithm. By accelerating and decelerating the motor properly, the system ensures that the application will operate efficiently and according to specifications. The particular algorithm selected, whether symmetric or asymmetric, is a critical part of designing an "ideal" application for the wine decanting control system.

The above examples of algorithm profiles are included to demonstrate preferred embodiments of the invention. It should be appreciated by those skilled in the art that the techniques disclosed in the example represent techniques discovered by the inventors to constitute preferred modes of practice. However, those skilled in the art should, in light of the present disclosure, appreciate that many changes can be made in the specific embodiments which are disclosed and still obtain a like or similar result without departing from the scope of the invention. For example, in the context of preferred embodiment, the algorithm may be generalized for use with a wide variety of wine or may alternatively be narrowly tailored to particular volumes and varietals. The accompanying actuating and display components may be readily adapted to reflect changes to and/or options afforded to the microcontroller by means of varying algorithms.

INDUSTRIAL APPLICABILITY

As noted above, there is a need in the art for an improved magnetically-driven wine aerating system that addresses problems in the prior art, particularly the problem of magnetic decoupling and vortex deficiency. The present invention addresses this need providing a multipurpose stirring, storing and serving vessel having a captive magnetic stirring impeller mechanically and physically attached thereto coupled with a programmable magnetic stir plate adapted for use therewith. Although described in detail with respect to vessels and impellers of a particular size and shape, it will be readily apparent to the skilled artisan that the utility of the present invention extends to other embodiments.

The disclosure of each publication, patent or patent application mentioned in this specification is specifically incorporated by reference herein in its entirety. However, nothing herein is to be construed as an admission that the invention is not entitled to antedate such disclosure by virtue of prior invention.

While the invention has been described in detail and with reference to specific embodiments thereof, it is to be understood that the foregoing description is exemplary and explanatory in nature and is intended to illustrate the invention and its preferred embodiments. Through routine experimentation, one skilled in the art will readily recognize that various changes and modifications can be made therein without departing from the spirit and scope of the invention. Such other advantages and features will become apparent from the claims filed hereafter, with the scope of such claims to be determined by their reasonable equivalents, as would be understood by those skilled in the art. Thus, the invention is defined not by the above description, but by the following claims and their equivalents.

What is claimed:

1. An integrated magnetic stirring decanter for wine aeration comprising:

a. a multi-purpose stirring, storage and serving vessel having an upper neck portion that includes an open spout in communication with a hollow interior, an intermediate body portion, and a lower base portion characterized by a relatively flat or planar stable bottom surface and a lowermost lateral groove disposed about the periphery of said vessel at or near said bottom surface that defines a raised rib at or adjacent to the bottom surface of the vessel;

b. a captive magnetic stirring impeller retained within said hollow interior, between said bottom surface and said lowermost lateral groove characterized by a flat, thin, flexible center support section carrying one or more vertically extending blade components, each of which houses a magnet component of magnetic, paramagnetic or ferromagnetic material that together define a first vertical summed magnetic field vector, and having a transverse wing component disposed at each free end;

wherein the diameter of stirring impeller is slightly larger than the diameter of the vessel measured at said lowermost lateral groove and slightly smaller than the diameter of the vessel measured at said bottom surface, further wherein said stirring impeller is introduced into the hollow interior via said open spout and subsequently snap fit within a section of the hollow defined by said raised rib, below said lowermost lateral groove and above said bottom surface, such that said impeller is centered about the bottom surface of said vessel such that said wing component(s) can freely spin within said rib section without contacting any surface of said vessel.

2. The integrated magnetic stirring decanter according to claim 1, wherein said support section comprises 2-6 arms that extend radially from a center point and an identical number of transverse wing components, wherein each of said wing components comprises an arcuate member symmetrically disposed about the end of each arm.

3. The integrated magnetic stirring decanter according to claim 2, wherein said support section comprises a rectangular member comprised of two opposed arms radiating from a center point, wherein each of said arms carries a relatively triangular blade components, wherein said blade components are symmetrically arranged about said center point.

4. The integrated magnetic stirring decanter according to claim 3, wherein said blade components are normal to the plane defined by said support section.

5. The integrated magnetic stirring decanter according to claim 3, wherein said blade components are pitched at an acute angle relative to the plane defined by said support section.

6. The integrated magnetic stirring decanter according to claim 3, wherein the ratio of the blade span to the blade height ranges from 5:1 to 3:1.

7. The integrated magnetic stirring decanter according to claim 3, wherein each magnet component is insert molded within a respective blade component so as to be completely encapsulated within said stirring impeller a minimum wall thickness of 1-2 mm all around.

8. The integrated magnetic stirring decanter according to claim 7, wherein each magnet component comprises a ceramic or rare earth magnet.

9. The integrated magnetic stirring decanter according to claim 7, wherein each magnet component comprises a fully magnetized Neodymimium (NdFeB) magnet.

10. The integrated magnetic stirring decanter according to claim 1, wherein said vessel is blow molded from a glass, polycarbonate, acrylic, and/or tempered glass material whereby the center of said bottom surface is characterized by a convex dimple, further wherein the center of said stirring impeller is aligned with and rests upon said convex dimple.

11. The integrated magnetic stirring decanter according to claim 1, wherein said vessel stirring impeller is injection molded from a plastic or polymeric material that is suitable for food use, has a low modulus of elasticity and a low coefficient of friction to include a substantially planar bottom surface, further wherein the bottom surface of said stirring impeller includes an integral boss disposed at the center that establishes a clearance between the bottom surface of said wing component(s) and the bottom surface of said vessel.

12. The integrated magnetic stirring decanter according to claim 1, wherein the intermediate body portion of said vessel comprising a plurality of relatively parallel grooves disposed about the periphery of said vessel that define a corresponding plurality of raised ribs that together serve to optimize vortex formation.

13. The integrated magnetic stirring decanter according to claim 1, wherein said vessel comprises a carafe or flask characterized by a relatively conical, ovoid, or rounded body portion that tapers to a relatively long and cylindrical neck portion.

14. The integrated magnetic stirring decanter according to claim 1, wherein said open spout includes a flared lip adapted to mate with an optional closure mechanism selected from the group consisting of rubber, glass and acrylic stoppers useful for storage purposes.

15. The integrated magnetic stirring decanter according to claim 1, wherein the diameter of the vessel varies along the height, broadening from widened base to a maximized hip and then tapering to a narrowed neck, further wherein the ratio of height to maximum diameter ranges from 2:1 to 4:1.

16. An automated wine aeration system comprising the integrated magnetic stirring vessel of claim 1 coupled with a magnetic stir plate, wherein said magnetic stir plate comprises:

a. a housing containing a DC motor driven by a DC power source via an associated power transistor, wherein said DC motor drives a horizontally disposed rotor bar and is activated by an actuator mechanism disposed on the exterior of said housing;

b. a PC circuit board integrated with said housing that includes a pre-programmed microcontroller for regulating the acceleration and deceleration of said DC motor in response to said actuator mechanism;

c. a pair of coupling magnets of opposite polarity attached to said rotor bar, wherein activation of said motor causes said coupling magnets to rotate in a horizontal plan and define a second vertical summed magnetic field vector; and d. one or more recessed positioning elements disposed about the periphery of the top surface of said housing that are sized to mate with the base of said stirring vessel and align the center of the stirring impeller with the center of the stir plate and thus align said coupling magnets and with said impeller magnets, such that said first vertical summed magnetic field vector overlaps with said second vertical summed magnetic field vector.

17. The automated wine aeration system according to claim 16, wherein the microcontroller includes one or more pre-programmed acceleration/deceleration speed profiles, each of which is optimized for a particular type of wine.

18. The automated wine aeration system according to claim 17, wherein the pre-programmed microcontroller generates a select pulse width modulated (PWM) signal that controls the speed of said motor in accordance with a selected speed profile.

19. The automated wine aeration system according to claim 18, wherein the speed profile dictated by said PWM signal is asymmetric.

20. The automated wine aeration system according to claim 19, wherein the acceleration/deceleration cycle is complete within 6 to 12 minutes.

21. The automated wine aeration system according to claim 18, wherein said pre-programmed microcontroller is associated with a visual display.

22. The automated wine aeration system according to claim 21, wherein said actuator mechanism is a push button control switch and said visual display is a dual LED.

23. The automated wine aeration system according to claim 22, wherein activation of said push button control switch automatically activates said microcontroller and said associated program and PWM output.

24. The automated wine aeration system according to claim 16, wherein said pre-programmed microcontroller includes a Digital to Analog (DAC) converter function that is used to obtain variable rotation speeds, wherein DAC output operates said power transistor that in turn drives said motor.

25. The automated wine aeration system according to claim 16, wherein said PC circuit board further comprises a smart charge microcontroller.

26. The automated wine aeration system according to claim 16, wherein said rotor bar comprises an iron and plastic assembly that is attached to a motor shaft that is driven by said motor.

27. The automated wine aeration system according to claim 16, wherein said DC power source comprises a low voltage DC power source transmitted through a DC power jack.

28. The automated wine aeration system according to claim 16, wherein said DC power source comprises an alternating current (AC) transformed to DC power from a wall-mounted transformer.

29. The automated wine aeration system according to claim 16, wherein said DC power source comprises a rechargeable battery that may be optionally integrated with said housing.

* * * * *